United States Patent [19]

Maruko et al.

[11] Patent Number: 4,982,487

[45] Date of Patent: Jan. 8, 1991

[54] METALLIC COMPONENT COLD ROLL/CRIMPING TOOL

[75] Inventors: Shuji U. Maruko, Orange; Richard R. Mulliner, Fullerton, both of Calif.

[73] Assignee: Hughes Aircraft Company, Los Angeles, Calif.

[21] Appl. No.: 263,675

[22] Filed: Oct. 27, 1988

[51] Int. Cl.[5] ..... B23P 11/00; B21D 39/18; B21D 39/02

[52] U.S. Cl. ..... 29/243.58; 72/211; 72/214

[58] Field of Search ..... 29/243.5, 243.57, 243.58, 29/509; 72/51, 52, 176, 177, 181, 187, 192, 210, 211, 214

[56] References Cited

U.S. PATENT DOCUMENTS

| | | | |
|---|---|---|---|
| 33,190 | 9/1861 | Fay | 72/214 |
| 1,976,148 | 10/1934 | Sonntag | 29/243.5 |
| 2,313,228 | 3/1943 | Domonkos | 72/211 |
| 2,459,585 | 1/1949 | Robinson | 29/509 |
| 3,017,694 | 1/1962 | Goldsmith | 29/509 |
| 3,183,701 | 5/1965 | Cain | 29/509 X |
| 3,797,430 | 3/1974 | Boudreau | 29/243.57 |
| 4,064,819 | 12/1977 | Fox | 29/243.58 |
| 4,324,031 | 4/1982 | Isenhoff | 29/243.5 X |

FOREIGN PATENT DOCUMENTS

| | | | |
|---|---|---|---|
| 309992 | 12/1955 | Switzerland | 72/176 |
| 897075 | 5/1962 | United Kingdom | 72/210 |

*Primary Examiner*—E. Michael Combs
*Attorney, Agent, or Firm*—Wanda K. Denson-Low

[57] ABSTRACT

A technique for sealing a housing (10) is disclosed characterized by use of a multi-stage tool (50) specifically adapted to progressively cold roll and crimp seal one or more flanges (18) formed on a component (12) over a beaded edge (24) which, in one embodiment, may be formed on another component (14). The multi-stage tool (50) includes a series of laterally spaced roller dies (56A,56B,56C) configured to structurally support desired walls (15,16) of one or more of the components (12,14) during the process as well as progressively roll form and crimp the flanges (18) about the beaded edge (24) of the component (14).

16 Claims, 2 Drawing Sheets

Fig. 1
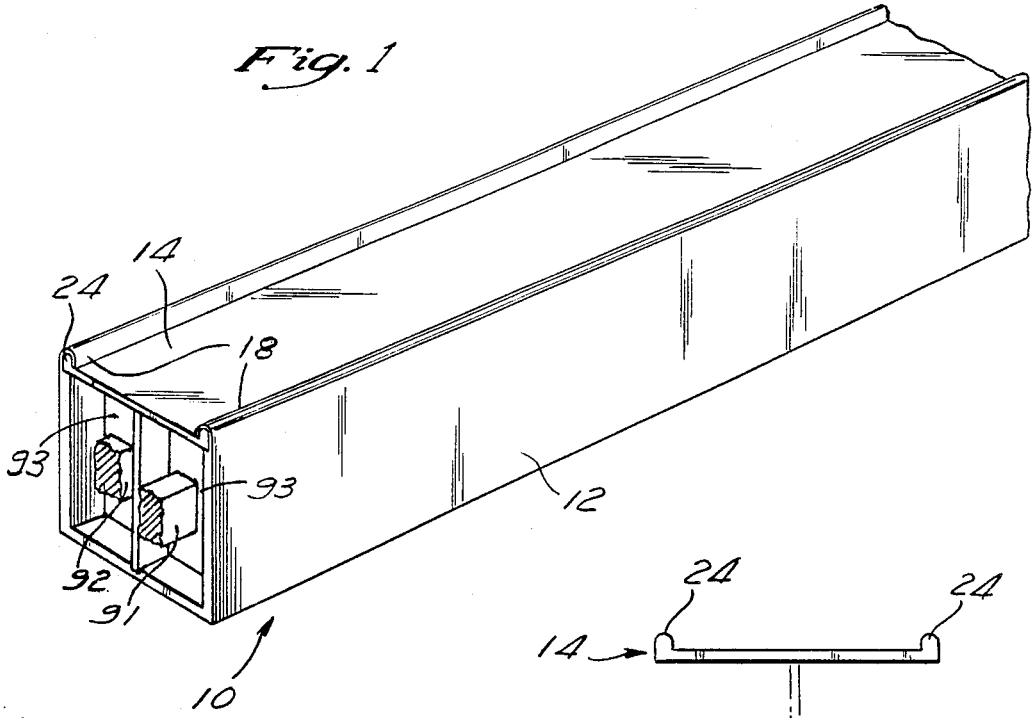
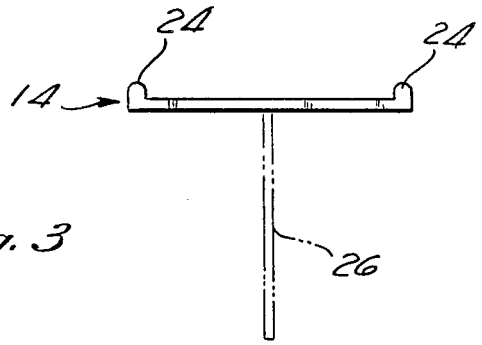
Fig. 3
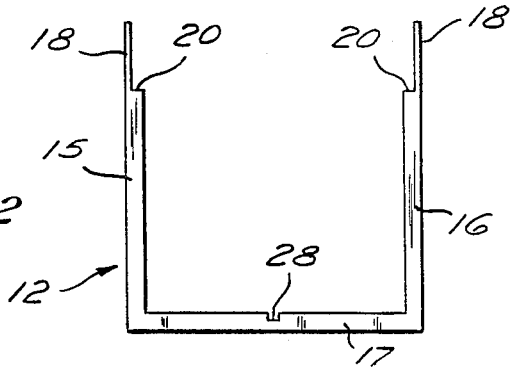
Fig. 2

METALLIC COMPONENT COLD ROLL/CRIMPING TOOL

This invention was made with Government support under contract number F30602-87-C-0075 awarded by the Department of the Air Force. The Government has certain rights in this invention.

FIELD OF THE INVENTION

The present invention relates generally to assembly processes and, more particularly, to a tool and a method for sealing an enclosure or a housing.

BACKGROUND OF THE INVENTION

As is well known, in the production of manufactured products, it is typical to enclose various components of the manufactured products within a protective housing. Such housings typically have been assembled in numerous ways, such as by mechanical fasteners, soldering, brazing, and/or welding.

Such prior art housings and techniques for assembling such housings possess inherent deficiencies when utilized in the assembly of modern, heat-sensitive components, such as electrical or microwave devices. For instance, it is customary practice for modern, heat-sensitive microwave devices to be enclosed within a sealed housing to protect the microwave devices throughout prolonged use. Typical of such microwave devices is a microwave series feed assembly consisting of a main feed line coupler and auxiliary coupler elements which are assembled (or packaged) together with numerous heat sensitive dielectric insulators, all of which are enclosed within an elongate aluminum rectangular conduit. Heretofore, it was customary practice to enclose such sealed microwave devices in an aluminum rectangular conduit by use of threaded fasteners, solder, dip brazing, arc welding, or laser welding to attach and seal a cover to the conduit or chassis after component assembly. Such prior art fastening or attachment techniques, however, have proven infeasible when new technology requirements dictate that the enclosure be lightweight, low cost, contain heat sensitive components, and/or be extremely long in length.

In this regard, the prior art use of mechanical fasteners, such as threaded fasteners, requires additional material to be provided on each side of the housing of the device to accommodate such mechanical fasteners. Further, such mechanical fasteners must be spaced at very close intervals to achieve the required structural or electrical performance characteristics of the device. The use of such additional material and fasteners necessarily results in a device having increased weight and size.

The prior art soldering assembly techniques require nickel and tin pre-plating of areas to be joined prior to soldering. Further, the heat required for proper soldering applications oftentimes damages heat-sensitive components contained within the microwave device. Further, the structural integrity of long microwave devices is suspect when the soldered joint is exposed to dynamic environments.

Similarly, the prior art dip brazing assembly techniques require that the entire housing be exposed to very high temperatures, i.e., approximately 1,000 degrees Fahrenheit in some cases, to achieve the desired integrity of the brazed joint. Such high temperatures typically anneals and distorts aluminum enclosures and further may damage the heat-sensitive components contained therein. Prior art arc-welding techniques additionally result in heat degradation similar to that of the dip-brazing process. In addition, arc welding requires a thicker wall section of metal be present in the weld area to eliminate possible burn-thru at the arc-welding site, which additional material increases the overall weight of the assembled device.

Finally, the prior art use of laser welding in the assembly process concentrates heat in a very small area so that thermal degragation of the microwave components is normally quite small. However, laser welding has been a slow and expensive process which typically renders it a cost ineffective assembly solution in many potential applications.

Thus, there exists a substantial need in the art for an improved method of assembling heat-sensitive components, such as microwave devices, within a sealed housing which is conducive to low cost, mass production techniques, and which additionally accomplishes assembly without generation of excessive heat that could degrade the heat-sensitive components disposed within the assembly.

SUMMARY OF THE PRESENT INVENTION

The present invention specifically addresses and alleviates the above-referenced deficiencies associated in the prior art by providing a low-cost, high-production rate, low-heat generating method of sealing an enclosure.

More particularly, the present invention utilizes a multi-stage tool specifically adapted to progressively cold roll and crimp seal one or more flanges over a beaded edge to seal the housing. The multi-stage tool includes a series of laterally spaced roller dies which are configured to provide a progressive degree of bend to the flanges with the last roller die providing a tight crimp of the flanges around the beaded edge located on the top surface of one component of the housing.

By use of the process of the present invention, one or more flanges may be crimped over one or more beaded edges of a housing at a rapid rate, which in one embodiment was approximately 20 feet per minute for aluminum, in a continuous operation without the generation of excessive heat, which could damage or degrade heat-sensitive components disposed and maintained within the interior of the housing components.

The number of roller dies required in the process is dependent upon the wall thickness, crimp radius, and physical properties of the housing components. For example, a 180-degree crimp of a 0.020 thickness 6061-T6 aluminum alloy flange preferably requires a minimum of three rollers to provide the sequential and progressive metal forming operation without fracturing the flange material. An embodiment of a cold roll crimping tool in accordance with the invention having three or more roller dies has been found to provide an alignment feature for the housing components during the forming process which is desirable when assembling long lengths of housing components.

Preferably, each of the roller dies includes a pair of large diameter rims which incorporate a radius about their inboard perimeter edge to guide the side walls of one of the housing components inwardly so that firm contact is achieved with the beaded edges of the other housing component. The rims of the roller dies additionally provide structural support to the side walls of the housing components during the rolling and crimping process. Such support eliminates possible buckling of the side walls of the housing components which could be occasioned by the substantial downward force created by the roller dies contacting the housing components during the process.

The enlarged rims of each of the roller dies are formed having the same configuration, whereas a camming surface formed adjacent the hub of each roller die is dissimilarly configured to progressively increase the angle of flange bend with the last roller die providing the final crimping operation.

Two basic methods of utilizing the cold rolling and crimping tool of the present invention for assembly purposes are contemplated. The first is to maintain the crimping tool stationary and laterally move the components to be rolled and crimped by way of a fixture past the stationary tool. This method allows the housing components to be laterally transported, i.e., fed automatically or manually at a desired speed. The second method contemplates maintaining the housing components to be rolled and crimped in a stationary fixture and subsequently laterally transporting the roller and crimping tool over the housing components.

The process of the present invention may be efficiently utilized for any housing components which are formed from a malleable or formable ferrous or non-ferrous metal provided that the bead radius of the housing components is equal to or greater than the recommended sheet metal bend radius for the selected material. The process may additionally be utilized when the housing components are formed from the same or differing metallic materials; however, when different metallic materials are utilized for the assembled housing components the effects of different coefficients of thermal expansion and positions on the galvanic scale must be considered.

The housing components desired to be roll-formed and crimped together in the assembly process may be fabricated by conventional manufacturing techniques. The optimum fabrication technique is believed to be extrusion because of the dimensional consistency and cost effectiveness of this technique. However, other fabrication techniques, including machining and sheet metal forming, are contemplated herein.

By use of the present invention, significant cost reductions in the assembly of housing components are facilitated due to the ability to cold roll and crimp multiple flanges of the housing components in a single high-speed process. Further, since the only material for the housing components required in the process is that which is needed to provide the structural support for the final product, material costs and weight are substantially reduced over prior art threaded fasteners, and/or welding fabrication techniques. Further, due to the process occurring with only negligible heat being transferred to the housing components, the original structural characteristics of the housing components are maintained after assembly, thereby allowing less material to be required for structural purposes in the overall design of the housing components.

DESCRIPTION OF THE DRAWINGS

These, as well as other features of the present invention, will become more apparent upon reference to the drawings wherein:

FIG. 1 is a perspective view of assembled housing components fabricated by the method of the present invention;

FIG. 2 is an end view of the channel housing component of the present invention illustrating the plural flanges formed adjacent its top edges;

FIG. 3 is an end view of the cover housing component of the present invention depicting the beaded edges formed on its top surface;

DETAILED DESCRIPTION OF THE PREFERRED EMBODIMENT OF THE INVENTION

Figure 4:
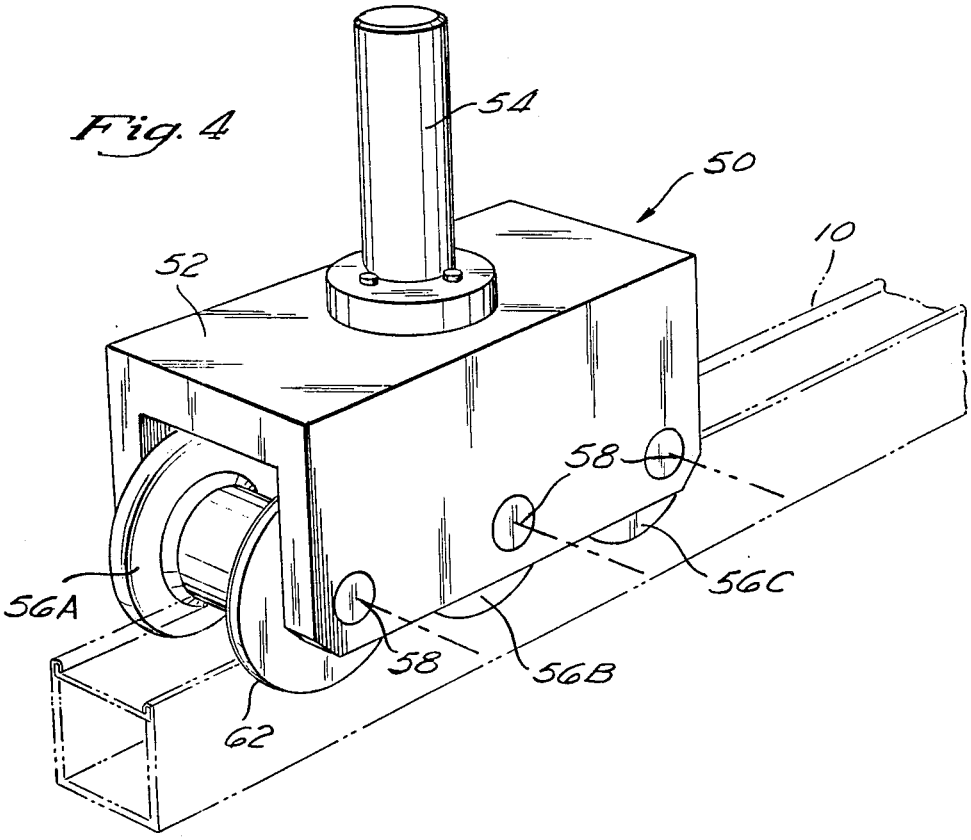
FIG. 4 is a perspective view of the cold roll/crimping tool utilized in the process of the present invention.

Referring to FIG. 1, there is shown the assembly 10 of a pair of housing components 12 and 14 assembled in accordance with the metallic component cold roll/-crimping assembly tool and process of the present invention. By way of illustration and not by limitation, the particular assembly 10 comprises a microwave series feed device consisting of a main feed line coupler 91 and auxiliary coupler elements 92 disposed with numerous heat-sensitive dielectric insulators 93 (illustrated schematically) enclosed within an elongate rectangular conduit or housing formed from the housing components 12 and 14. Those skilled in the art will recognize, however, that the assembly process of the present invention is specifically adapted for use in the assembly of many heat-sensitive components within differing sized and configured housing components. Additionally, for purposes of this application, the terms "heat-sensitive components" and "housing components" shall be defined in their broader sense to define all such structures.

Referring more particularly to FIG. 2, it can be seen that the housing component 12 is preferably formed as an elongate channel having a generally U-shaped cross-sectional configuration defined by side walls 15 and 16, and bottom wall 17. One or more elongate flanges 18 are provided on the distal ends of the side walls 15 and 16 and extend outwardly therefrom. As shown, the flanges 18 are formed to have a wall thickness which is less than the wall thickness of the side walls 15 and 16 so as to be conducive to the cold roll forming process of the present invention. A pair of shoulders 20 are additionally provided at the distal end of the side walls 15 and 16 which, as will be described hereinafter, define support surfaces for the housing component 14 during the assembly process.

Referring to the embodiment shown in FIG. 3, the housing component 14 is formed as an elongate, substantially planar cover member having a width equal to or slightly less than the width across the shoulders 20 formed on the housing component 12. A pair of raised beads 24 are formed at the distal edges of the housing member 14 and preferably extend throughout its length. An optional elongate support rib 26 may additionally be provided, the length of which is formed to be equal to or slightly greater than the height of the side walls 15 and 16 so as to contact the bottom wall 17, or reside within an optional elongate recess 28 formed within the bottom wall 17 of the housing component 12 (shown in FIG. 2) when the housing component 14 is nested upon the shoulders 20 of the housing component 12.

The housing components 12 and 14 may be formed from any ferrous or non-ferrous metal which is malleable or formable in a cold rolling process. However, in the preferred embodiment, the housing components 12 and 14 are fabricated of aluminum. Further, the housing components 12 and 14 may be fabricated by conventional machining and/or sheet metal forming techniques but preferably are formed by an extrusion process to maintain dimensional consistency and cost effectiveness.

Although the number and precise dimensions of the flanges 18 and beads 24 will vary depending upon the metallic material and overall size and configuration of the housing components 12 and 14 and the electrical and mechanical performance desired, the applicants have found that superior cold rolling assembly by the process of the present invention can be effectuated by forming the wall thickness of the flanges 18 at approximately 0.5 mm (0.020 inch) and the radius of the beads 24 at approximately 0.762 mm (0.030 inch) when the housing components 12 and 14 are formed from 6061-T6 aluminum alloy material. As will be recognized, however, the bead radius in all instances must be at least equal to the recommended sheet metal bend radius of the selected material for the flanges 18 to avoid any possibility of catastrophic fracture of the flanges 18 in the assembly process. Additionally, in the preferred embodiment both housing components 12 and 14 are formed from the same material, although the housing components may consist of differing materials when desired. As will be recognized, when different materials are selected for the housing components 12 and 14, consideration of the effects of different coefficients of thermal expansion of the materials and their positions on the galvanic scale values must be carefully considered.

Referring to FIG. 4, a multi-stage tool designated generally by the numeral 50 is depicted, which is specifically adapted to progressively cold roll and crimp seal the flanges 18 formed on the housing component 12 over the beaded edges 24 formed on the housing component 14. As shown, the tool 50 is composed of a carrier 52 having a generally inverted U-shaped cross-sectional configuration and includes a cylindrical shank 54 extending perpendicularly outward therefrom which is adapted to be received within a conventional tool holder. Plural roller dies 56A, 56B, and 56C are journaled for rotational movement about parallel axes 58 which extend throughout the interior of the carrier 52. Each of the roller dies 56A, 56B, and 56C is specifically formed to progressively cold roll form the flanges 18 relative to the beads 24 during relative lateral movement between the housing components 12 and 14 and the tool 50. In the embodiment of the tool 50 shown in FIG. 4, the roller die 56A comprises a first preform roller, the roller die 56B comprises a second preform roller, and the roller die 56C comprises a crimping roller, all of which progressively cold roll form the flanges 18 about the beaded edges 24.

Figure 5:
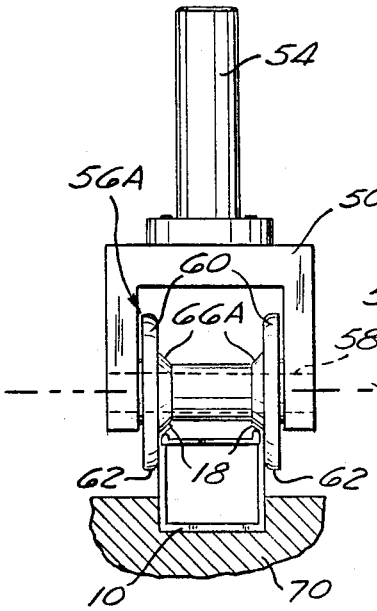
FIG. 5 is an end view of a first preform roller die utilized on the roll/crimping tool of FIG. 4.
Figure 6:
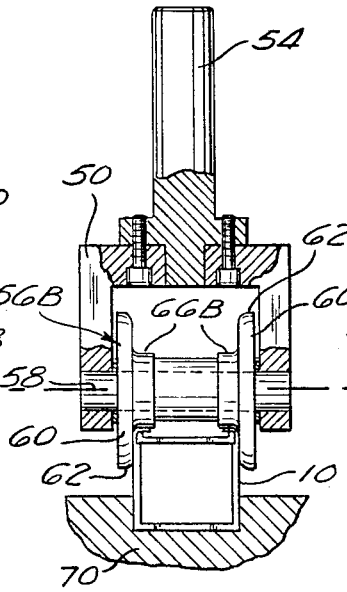
FIG. 6 is an end view of a second preform roller die utilized on the roll/crimping tool of FIG. 4.
Figure 7:
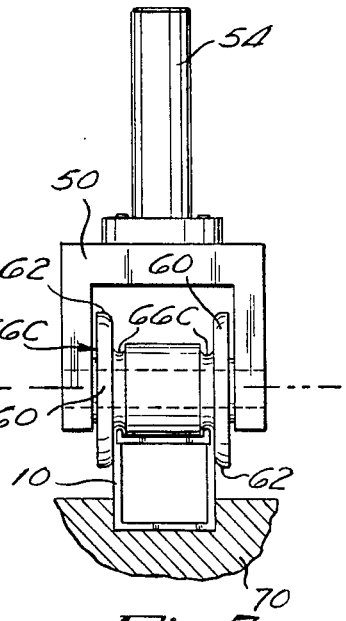
FIG. 7 is an end view of the crimping roller die utilized on the roll/crimping tool of FIG. 4.

Referring to FIGS. 5, 6, and 7, it will be noted that all of the roller dies 56A, 56B, and 56C are provided with a pair of enlarged annular rims 60 which include a generous radius 62 about their inboard periphery to provide a guide surface which biases the side walls 15 and 16 of the housing component 12 inwardly upon contact with the rims 60. Further, the rims 60 are preferably formed having a diameter sufficient to extend downwardly along the length of the side walls 15 and 16 a sufficient distance to provide structural support for the housing component 12 during the rolling and crimping operation. Such structural support eliminates any possible buckling of the side walls 15 and 16 due to the inherent downward force created by the tool 50 pressing against the housing component 12 during the assembly process.

It will be noted that each of the roller dies 56A, 56B, and 56C includes a pair of annular camming surfaces 66A, 66B, and 66C, respectively, which are adapted to contact the flanges 18 and roll form or bend the same to a desired orientation relative the beaded edges 24. With specific reference to the first preform roller 56A, the annular camming surface 66A is formed in a frusto-conical shaped configuration, preferably having a side wall angle of approximately 45 degrees relative the central axis 58 of the roller die 56A such that upon contact with the flanges 18, the flanges 18 are bent inwardly approximately 45 degrees from their original upward orientation.

In relation to the second preform roller die 56B, the annular camming surfaces 66B are preferably formed having a cylindrical configuration whereby upon contact with the flanges 18, the flanges are bent inwardly to an orientation approximately 90 degrees from their initial orientation. In relation to the crimping roller die 56C, the annular camming surfaces 66C preferably comprise a radiused cylindrical surface having a radius equal to or slightly less than the radius of the bead 24 formed on the housing component 14, plus the thickness of the flange 18. This particular dimension for the radiused annular cam surface 66C has been found to provide the required crimping force to compress and cold roll form flanges 18 tightly against the beaded edges 24 and thereby result in a tight, uniformly sealed assembly joint along the entire length of the housing segments 12 and 14.

With the structure defined, the metallic component cold roll crimping assembly process of the present invention may be described with specific reference to FIGS. 1, 5, 6, and 7. Initially, the multi-stage tool 50 is mounted via its shank 54 into a tool holder (not shown) and the housing components 12 and 14 may be disposed within a holding fixture 70. The diameters of the rims 60 and the depth of the holding fixture 70 are chosen in the preferred embodiment to leave only a minimal unsupported area of the housing component 12. In the preferred embodiment, the shank 54 of the tool 50 may be mounted within a tool holder of a conventional milling machine while the fixture 70 may be anchored to the work table of the milling machine. Subsequently by locking the milling machine spindle to prevent rotation about the axis of the tool shank 54, the table of the milling machine may be traversed in a longitudinal direction causing the housing components 12 and 14 to be contacted by the roller dies 56A, B, and C of the tool 50. Alternatively, it will be recognized that the fixture 70 may be maintained in a stationary position, while the tool holder 50 is mounted in a support structure which is adapted to traverse the length of the fixture 70 and contact the housing components 12 and 14.

As will be recognized, preparatory to final assembly of the housing components 12 and 14, various heat-sensitive devices and components 91, 92, and 93 (shown schematically in FIG. 1) are disposed within the interior of the housing component 12 and, subsequently, the housing component 14 is nested upon the housing component 12 with the edges of the housing component 14 being supported upon the shoulders 20 formed on the housing component 12. Subsequently, relative lateral movement between the housing components 12 and 14 and the tool 50 causes the leading edges of the side walls 15 and 16 of the housing component 12 to contact the inboard annular surface of the pair of annular rims 60 of the first preform roller die 56A. Due to the spacing of the annular surfaces of the rim 60 being equal to the width of the housing component 12, such contact serves to self-register the housing component 12 and housing component 14 carried thereupon relative the roller dies 56A, 56B, and 56C. Continued lateral movement between the housing components 12 and 14 and tool 50 causes the leading edges of the flanges 18 to contact the annular camming surface 66A formed on the preform roller 56A whereby the flanges 18 are bent to an approximate 45-degree angle from their initial orientation, as indicated in FIG. 5.

Continued relative movement between the housing components 12 and 14 and the tool 50 causes the preformed flanges 18 to contact the annular camming surface 66B of the second preform roller die 56B wherein the flanges 18 are further bent into an orientation approximately 90 degrees from their original orientation, as indicated in FIG. 6. Further relative movement between the components 12 and 14 and the tool 50 causes the preformed flanges 18 to contact the annular cam surfaces 66C formed in the crimping roller die 56C whereby the flanges 18 are crimped tightly against the raised edges 24 formed on the housing component 14.

As such, it will be recognized that by use of the present invention, the housing components 12 and 14 are assembled in a tight sealed relationship with one another without generating excessive heat which could be detrimental to the heat sensitive components contained within the interior of the housing components 12 and 14. Further, it will be recognized that by use of the present invention, significant cost benefits are obtained in that the process facilitates the cold rolling and crimping of multiple flanges in a single operation at a high assembly rate which, for an embodiment using aluminum alloys, has been found to be approximately 20 feet per minute of transverse movement of the components 12 and 14 relative to the tool 50.

For purposes of illustration, and by way of preferred embodiment, the tool 50 has been defined to include three roller dies 56A, 56B, and 56C. However, it will be recognized that the number of roller dies 56, as well as the particular preform and crimping procedures associated with each of the multiple roller dies, may be varied and selected as desired based upon the particular size, configuration, and material utilized in the housing components 12 and 14.

Thus, there has been disclosed a tool and technique for sealing a housing which uses no heat, other than that generated by the friction of the cold rolling process, and therefore, does not change the basic physical or metallurgical characteristics of the housing being sealed. As discussed above, dip brazing results in physical changes to the housing due to annealing and distortion caused by the high heat used.

Likewise, other materials may be used; e.g., the bead may be formed of a plastic material.

Further, it will be recognized that although for purposes of illustration certain components, structures, and dimensions have been defined herein, variations and modifications in the same are clearly recognized by those having ordinary skill in the art, and such variations and/or modifications are clearly contemplated herein. For example, housing components 12 and 14 have been shown, however, in a certain embodiment, a single sheet metal housing component may be used on which is formed a bead at one end and a flange at the other.

What is claimed is:

1. An apparatus for sealing a beaded top cover on a generally U-shaped metallic housing having spaced vertical sidewalls terminating in vertical flanges, the apparatus comprising:

a carrier adapted to be positioned adjacent one surface of the housing during relative lateral movement between said housing and said carrier; and plural roller dies rotatably mounted to said carrier and laterally spaced from one another to progressively bend and crimp the flanges formed on said housing about a raised bead formed on said top cover, wherein each of said plural roller dies includes a pair of registration members each dispersed in abutting registry with said housing vertical side walls to provide structural support to said housing during sealing.

2. The apparatus of claim 1 wherein at least a first one of said plural roller dies includes an annular camming surface formed to bend said flange into a position generally overlaying said raised bend formed on said housing.

3. The apparatus of claim 2 wherein a least one of said plural roller dies includes a last annular camming surface having a configuration substantially complimentary to the configuration of said raised bead to crimp said flange about said raised bead.

4. The apparatus of claim 3 wherein said first one of said plural roller dies includes a first annular camming surface and a second one of said plural roller dies includes a second annular camming surface, said first and second annular camming surfaces formed to progressively bend said flange into a position generally overlaying said raised bead formed on said housing.

5. The apparatus of claim 4 wherein the total number of said plural roller dies mounted to said carrier is selected to progressively bend and crimp said flange about said raised bead without fracturing said flange.

6. The apparatus of claim 5 wherein said last annular camming surface formed on said last one of said plural roller dies comprises an annular recess having a radius substantially equal to the radius of said raised bead plus the wall thickness of said flange.

7. The apparatus of claim 6 wherein each of said registration members comprises an annular rim formed on said plural roller dies sized to contact a side wall of said housing.

8. The apparatus of claim 7 wherein said registration member comprises a pair of annular rims formed on said plural roller dies, each sized to contact a side wall of said housing.

9. The apparatus of claim 8 wherein said flange is formed having a wall thickness less than the wall thickness of said housing.

10. The apparatus of claim 9 wherein said annular rim is formed having a diameter sized to extend along a portion of the side wall of said housing sufficient to prevent buckling of said side wall of said housing.

11. The apparatus of claim 10 wherein said plural roller dies are rotatably mounted to said carriage about parallel axes.

12. The apparatus of claim 11 wherein said first annular camming surface is formed having a frusto-conical shaped configuration.

13. The apparatus of claim 12 wherein said second annular camming surface is formed having a generally cylindrical configuration.

14. The apparatus of claim 13 wherein said carrier includes a cylindrical shank sized to be received within a tool holder.

15. The apparatus of claim 1 wherein each of said roller dies rotate about an axis of rotation perpendicular to the direction of relative lateral movement between said housing and said carrier.

16. The apparatus of claim 1 wherein said plural roller dies comprise three roller dies.

* * * * *